US006272427B1

(12) United States Patent
Wild et al.

(10) Patent No.: US 6,272,427 B1
(45) Date of Patent: Aug. 7, 2001

(54) METHOD AND DEVICE FOR CONTROLLING AN INTERNAL COMBUSTION ENGINE IN ACCORDANCE WITH OPERATING PARAMETERS

(75) Inventors: Ernst Wild, Oberriexingen; Manfred Pfitz, Vaihingen; Axel Stuber, Tamm; Nikolaus Benninger, Vaihingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/308,015

(22) PCT Filed: Aug. 7, 1998

(86) PCT No.: PCT/DE98/02271

§ 371 Date: Jul. 13, 1999

§ 102(e) Date: Jul. 13, 1999

(87) PCT Pub. No.: WO99/13208

PCT Pub. Date: Mar. 18, 1999

(30) Foreign Application Priority Data

Sep. 11, 1997 (DE) ..... 197 39 901

(51) Int. Cl.[7] ..... F02D 41/04; F02D 41/32

(52) U.S. Cl. ..... 701/108; 123/568.11; 701/103

(58) Field of Search ..... 123/435, 676, 123/679, 681, 478, 480, 540, 543, 568.11, 568.31, 678, 689; 701/101, 102, 103, 108

(56) References Cited

U.S. PATENT DOCUMENTS 4,549,518 * 10/1985 Koumura ..... 123/478
4,815,435 3/1989 Lefevre et al. .
5,113,832 5/1992 Heffron .
5,255,657 * 10/1993 Stellwagen ..... 123/527
5,522,365 * 6/1996 Milunas et al. ..... 123/480
5,586,544 12/1996 Kitamura et al. .
5,983,867 * 11/1999 Stuber et al. ..... 123/488

FOREIGN PATENT DOCUMENTS 196 28 235 6/1971 (DE) .
44 35 419 4/1996 (DE) .
2-112739 4/1990 (JP) .

* cited by examiner

*Primary Examiner*—Andrew M. Dolinar
*Assistant Examiner*—Arnold Castro
(74) *Attorney, Agent, or Firm*—Kenyon & Kenyon

(57) ABSTRACT

A method and a device for controlling an internal combustion engine as a function of performance characteristics such as load, engine speed, a corrected value for the intake air temperature being used for the control, the corrected value being obtained from the following formula:

$$TANSK=T1+(TWS-T1)*f$$

where

TANSK=corrected value of the intake air temperature,

T1=value (TANS) of the intake air temperature remote from the internal combustion engine determined by calculation or measured, TWS=value of the mean temperature of the intake manifold, f=weighting factor ranging from 0 to 1.

14 Claims, 4 Drawing Sheets

METHOD AND DEVICE FOR CONTROLLING AN INTERNAL COMBUSTION ENGINE IN ACCORDANCE WITH OPERATING PARAMETERS

FIELD OF INVENTION

The present invention is based on a method as well as a device for controlling an internal combustion engine as a function of performance characteristics, such as air filling, engine speed, engine temperature and intake air temperature. As far as the intake air temperature in particular is concerned, it has a number of effects on the behavior of the internal combustion engine. With otherwise identical ambient conditions, a higher intake air temperature produces effects including a higher knock tendency, improved evaporation of the fuels, reduced wall film formation of the fuels on the interior walls of the intake manifold as well as a reduction of the volume of air taken in and accordingly of the quantity of fuel required. Against this background, modern controls for internal combustion engines condition the intake air temperature, for which an appropriate sensor is inevitably required.

BACKGROUND INFORMATION

German Patent No. 44 35 419 A1, which relates to a "control system for proportioning the fuel of an internal combustion engine" and in which the intake air temperature value is used among other things for the determination of a warm start case, may be pointed out as exemplary of the extensive conventional methods in connection with the use of a signal of the intake air temperature in the context of the control of an internal combustion engine.

Primarily reasons relating to space requirements in the area of the internal combustion engine are the reason that sensors for the intake air temperature are usually not mounted in the immediate vicinity of the internal combustion engine but rather, for example, in the air filter housing, in a mass air flow meter, in the throttle valve connector or in combination with an intake manifold pressure sensor. The temperature measured with these sensors does not then correspond to the actual intake temperature in the vicinity of the intake valve which is relevant to the operation of the internal combustion engine when the intake air can become heated on the warm walls of the intake manifold on its path to the internal combustion engine. In internal combustion engines with exhaust gas recirculation, there is the additional heating of the intake air by an admixture of the hot exhaust gas.

It has now been shown that it is not always possible to obtain optimal results in relation to the influence of the intake air temperature with the conventional systems.

SUMMARY OF THE INVENTION

An object of the present invention is to specify a method as well as a device to make possible a determination of the intake air temperature which is relevant to the control of the internal combustion engine.

The present invention makes it possible to model the intake air temperature of an internal combustion engine in the vicinity of the intake valves by approximation. The basis for this is measurement of the intake air temperature upstream in the intake path, the heating of the intake air in the intake manifold on its way to the intake valves being additionally taken into account. In the case of exhaust gas recirculation, its contribution to the heating of the intake air is additionally included.

DETAILED DESCRIPTION

Figure 1:
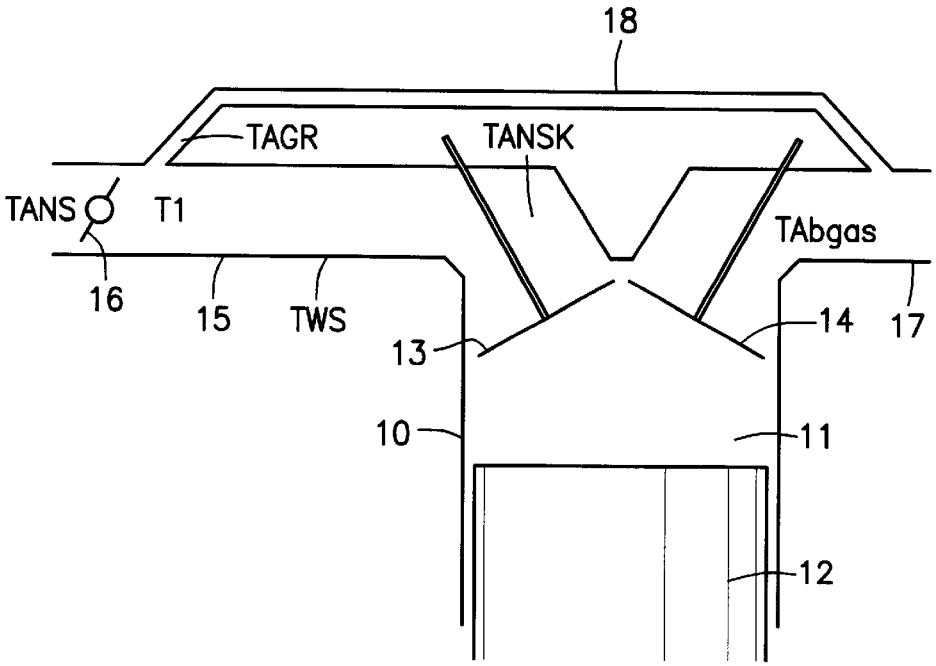
FIG. 1 shows an internal combustion engine with an intake manifold and an exhaust pipe.

FIG. 1 shows an overview of an internal combustion engine together with the intake manifold and exhaust pipe. The internal combustion engine itself is identified as 10 and one of the cylinders or combustion chambers as 11. The bottom of the combustion chamber is limited by a piston 12 and the top is limited by at least an intake valve 13 and an exhaust valve 14. In this connection, intake valve 13 forms the downstream end of an intake manifold 15 in which a throttle valve 16 is arranged further upstream. An exhaust pipe 17 is drawn in on the output side of the internal combustion engine. A connecting line 18 between exhaust pipe 17 and intake manifold 15 makes exhaust gas recirculation possible, whose volume is adjustable via a controllable valve which is not shown here.

To describe and explain the present invention temperature values are additionally entered in FIG. 1. Thus the intake air temperature before throttle valve 16 has a value identified as TANS; after the throttle valve, it has a value T1. The mean temperature of the intake manifold is identified as TWS. In the immediate area of input valve 13, the intake temperature has the value TANSK, which corresponds to a corrected intake air temperature value. After the exhaust valve, the exhaust gases have an exhaust gas temperature TAbgas. Finally, an additional value for the recirculated exhaust gas is drawn in in the area of the opening of exhaust gas recirculation line 18 into intake manifold 15 as TAGR.

An object of the present invention is to specify a value for the corrected intake air temperature TANSK on the basis of available measured and control values. This purpose is served by signal processing as indicated in a block diagram in FIG. 2. Values for intake air temperature TANS (block 20), mean intake manifold temperature TWS (block 21) and the air volume (block 22) are supplied at the input side in this representation of FIG. 2. The signal of the corrected intake air temperature TANSK is available at an output 23.

The corrected value of the intake air temperature TANSK is formed according to the formula $$TANSK=T1+(TWS-T1)*f$$

in which

TANSK=corrected value of the intake air temperature,

T1=value (TANS) of the intake air temperature remote from the internal combustion engine determined by calculation or measured, TWS=value of the mean temperature of the intake manifold and f=weighting factor ranging from 0 to 1.

Figure 2:
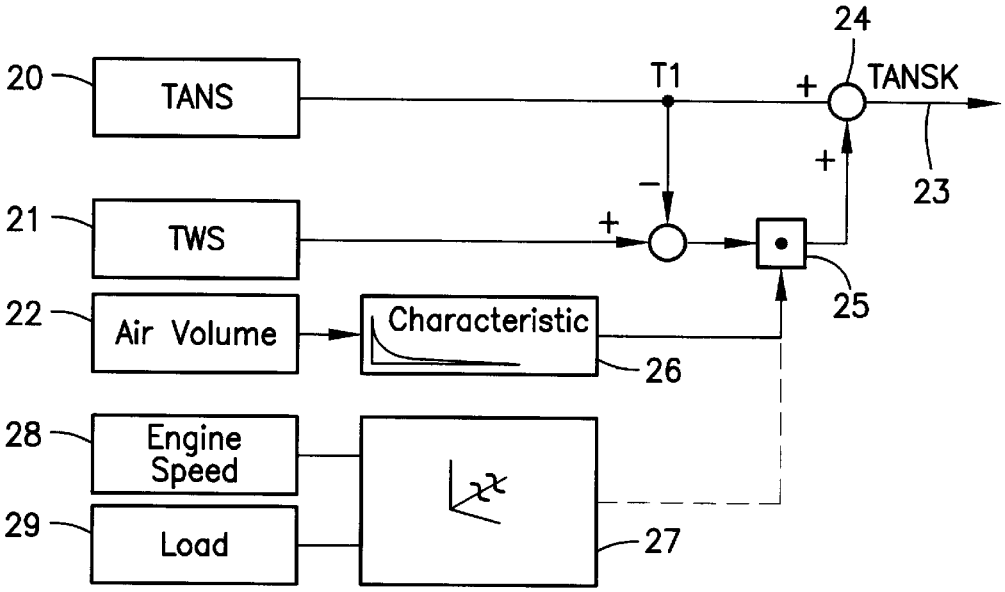
FIG. 2 shows a block diagram of a signal processing for a formation of a corrected value of an intake air temperature.

To supply the corrected value of intake air temperature TANSK, according to FIG. 2, signal T1 or TANS arrives at a summing point 24, whose second input receives the output signal supplied by a multiplication point 25. For its part, this multiplication point 25 receives a differential value between the value of the mean temperature of intake manifold TWS and the value TANS or T1. At the second input of multiplication point 25, output signal f of a characteristic 26 is supplied, whose input variable is air volume (22).

Supplementary to this or as an alternative, the output signal of a characteristic map 27 can be supplied to multiplication point 25, the input variables of the characteristic map being signals for engine speed and load (28, 29).

A comparison of the representation of FIG. 2 with the formula indicated above makes it clear that weighting factor f is formed on the basis of signals for air volume 22 and/or engine speed 28 as well as load 29.

It is essential for this weighting factor f to be a function of performance characteristics, these performance characteristics being characteristic of the air flow to the internal combustion engine. In this sense, a signal in relation to the throttle valve angle as well as the pressure in the intake manifold, for example, could be used as well.

Figure 3:
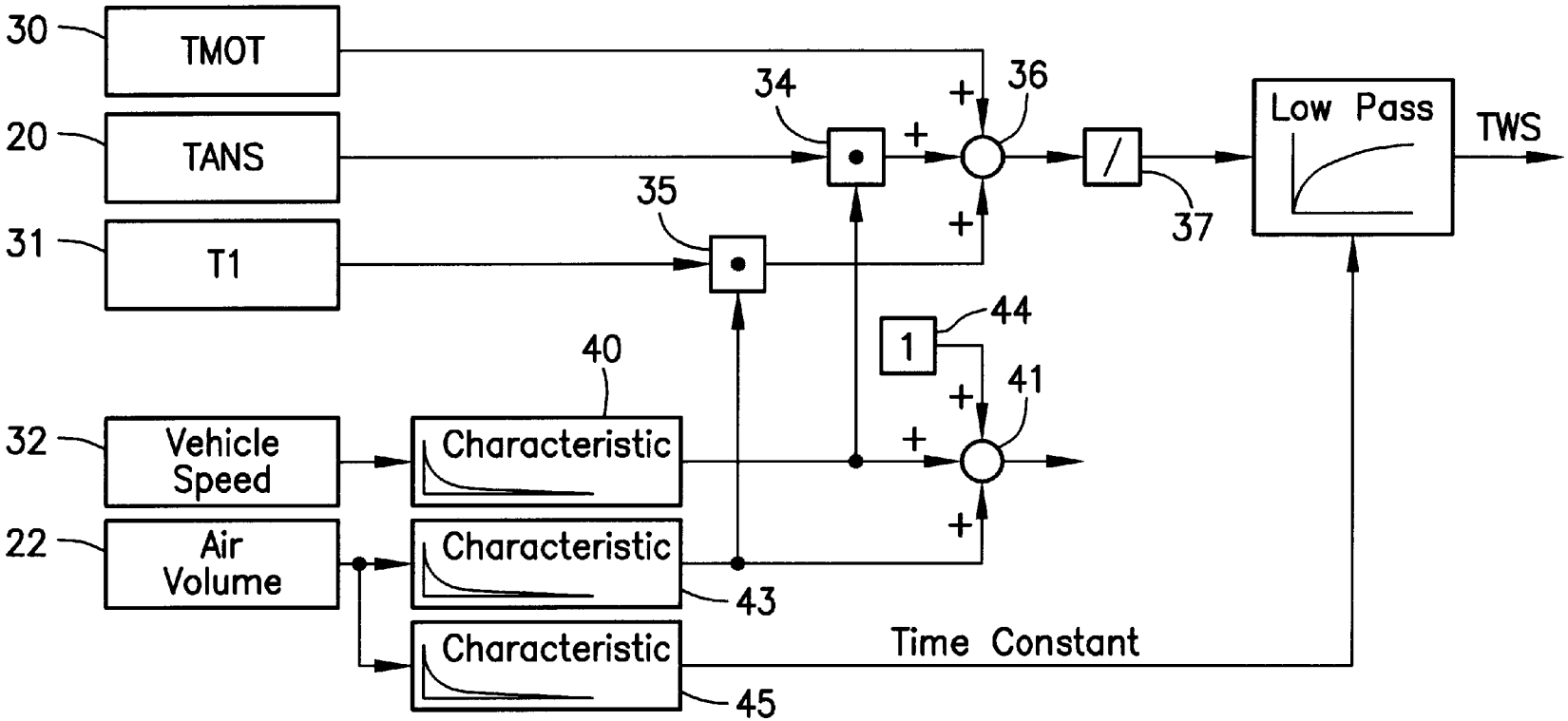
FIG. 3 shows a block diagram of the signal processing for the formation of a value of a mean temperature of the intake manifold.

The block diagram of the signal processing of FIG. 2 requires the knowledge of the mean temperature value of intake manifold TWS. FIG. 3 shows a possibility for the formation of a corresponding temperature value based on various input variables. In this connection, the elements known from FIG. 2 are provided with the reference numbers already used there. A sensor for the temperature of the internal combustion engine TMOT is identified as 30. A signal T1 is supplied via block 31. In this connection, T1 corresponds to intake air temperature TANS in cases in which no exhaust gas circulation occurs. With a view to a general representation, however, this signal value T1 was shown separately in FIG. 3. A signal relating to vehicle speed is supplied via a sensor 32.

The output signals from blocks 20 and 31 are each supplied to a multiplication point 34 and 35, respectively. On the output side, these two multiplication points 34 and 35 are connected to an addition point 36, to which signal TMOT is also supplied. The composite signal formed represents the enumerator in an adjoining division point 37, whose output via a low pass 38 in turn ultimately corresponds to output signal TWS as the mean temperature of the intake manifold.

Vehicle speed signal 32 arrives at a characteristic 40, whose output is connected to both multiplication point 34, as well as an addition point 41, which in turn supplies the denominator signal for division point 37. Correspondingly, a characteristic 43 follows block 22 for the representation of an air volume signal, the output of the characteristic forming the second signal of multiplication point 35 and also being supplied to addition point 41. A constant value from a constant value memory 44 is additionally supplied to this addition point. Finally, an additional characteristic 45 is provided which receives air volume signal 22 as its input signal and determines the time constant of the filter or low pass 38 on the output side.

The combined circuitry shown in FIG. 3 can be expressed by the following formula:

$$TWS(\text{unfiltered})=(TMOT+TANS*K1)/(1+K2)$$

where

TMOT=internal combustion engine temperature, water temperature

TANS=measured value of the intake air temperature remote from the internal combustion engine K1=characteristic value as a function of vehicle speed and/or air volume K2=characteristic value as a function of vehicle speed and air volume (FIG. 3).

Figure 4:
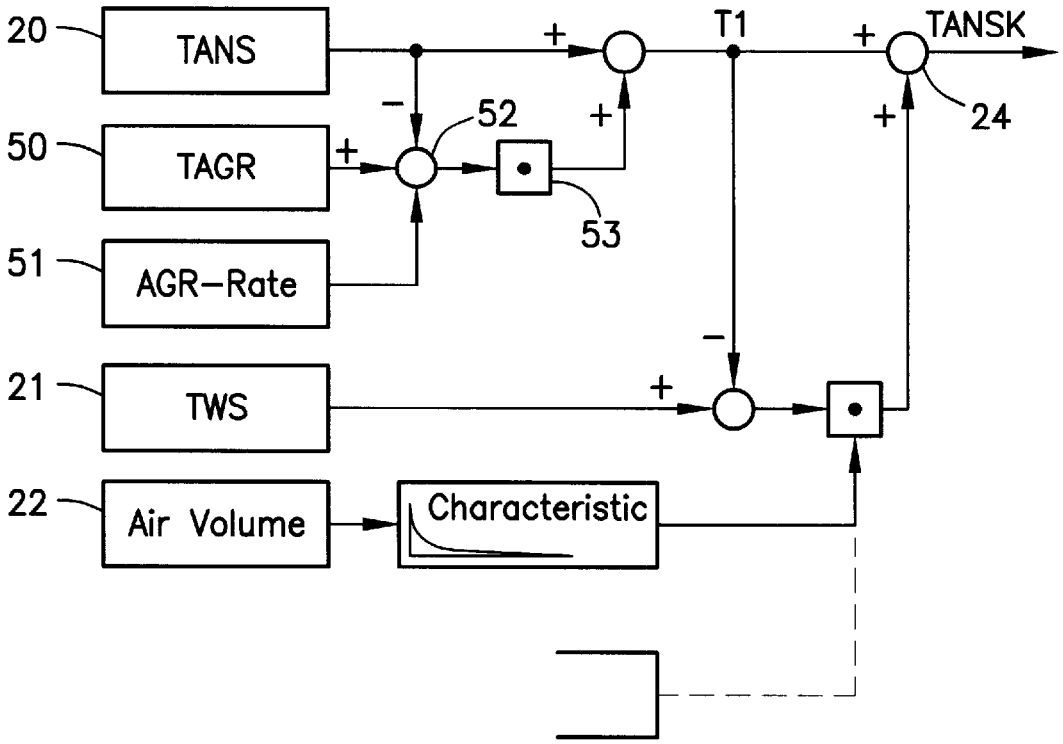
FIG. 4 shows a block diagram of the signal processing for the formation of the corrected value of the intake air temperature with an exhaust gas recirculation.

FIG. 4 corresponds largely with the representation of FIG. 2 with the difference that the influences in connection with exhaust gas recirculation are additionally included. According to this representation, T1 is obtained as the air intake temperature value T1 remote from the internal combustion engine which is determined by calculation as $$T1=TANS+AGR\ \text{rate}*(TAGR-TANS)$$

in which

AGR rate=the rate of the recirculated exhaust gas and

TAGR=the temperature of the recirculated exhaust gas.

To form the signal value for T1, a value for the temperature of the recirculated exhaust gas TAGR (block 50) and a rate for the recirculated exhaust gas (AGR rate 51) are processed as input variables. In a subtraction point 52, the difference between the temperature values of the recirculated exhaust gas and the intake air temperature is formed and subsequently multiplied with the exhaust gas recirculation rate in a multiplication point 53. The sum of the output signals of multiplication point 53 and of the intake air temperature then forms temperature value T1 for the intake air-exhaust gas mixture downstream of throttle valve 16 in the area of the opening point of exhaust gas recirculation pipe 18 into intake manifold 15.

Figure 5:
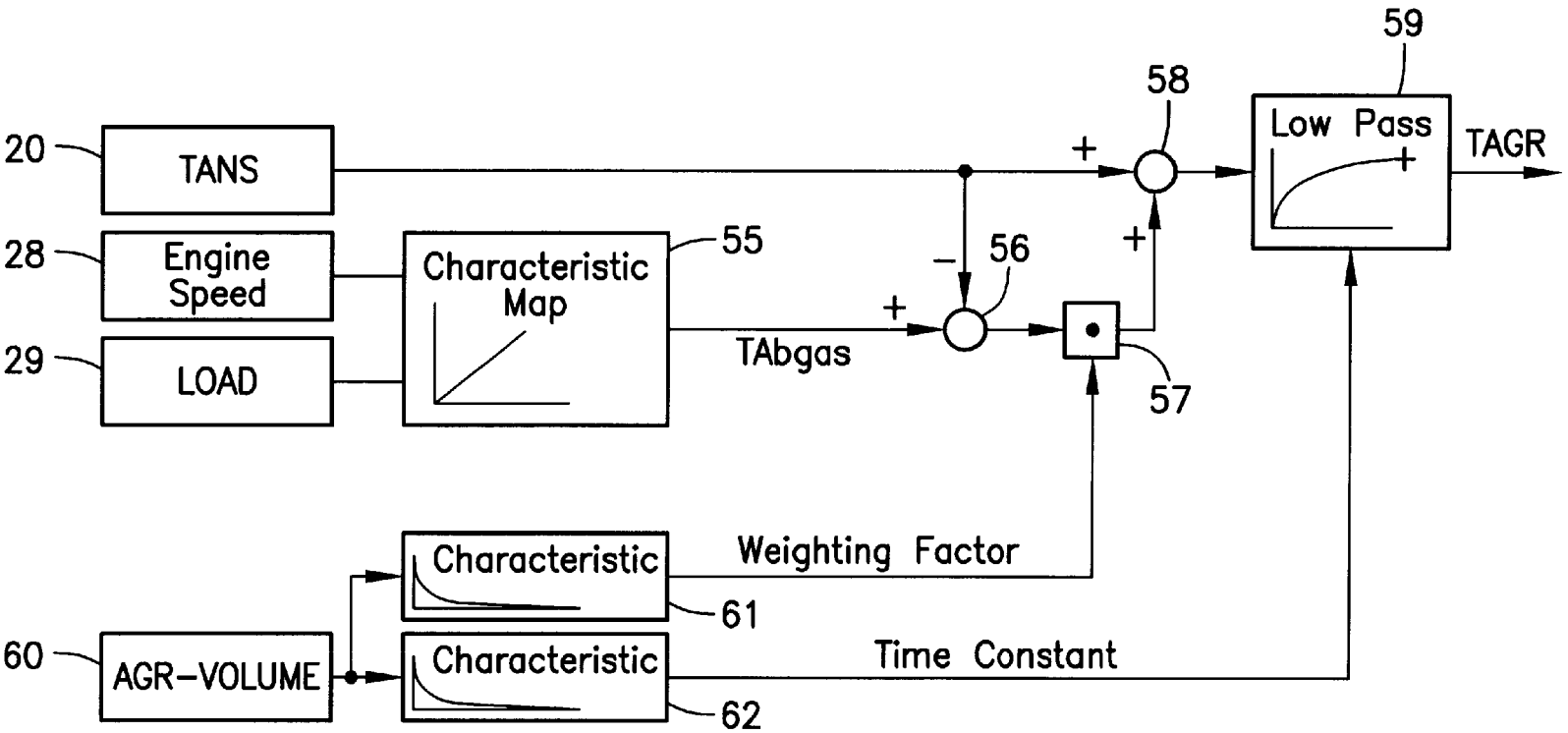
FIG. 5 shows a block diagram of the signal processing for the formation of a value of the temperature of a recirculated exhaust gas.

The temperature signal required for the recirculated exhaust gas in connection with the signal processing of FIG. 4 can be formed from various measured or calculated variables corresponding to the block diagram of FIG. 5. Thus the temperature value of the recirculated exhaust gas according to FIG. 5 is obtained as a low pass filtered signal as a function of the values for intake air temperature, engine speed, load and the volume of the recirculated exhaust gas (AGR volume). A control signal for the actuator in the exhaust gas recirculation line which processes as a function of performance characteristics may serve, for example, as a measure of this.

According to FIG. 5, an estimated value for the exhaust gas temperature TAbgas downstream of exhaust valves 14 is formed based on the signals for engine speed and load (28, 29) via a characteristic map 55. The difference between the value TAbgas and intake air temperature TANS is determined in a difference forming point 56; it is subsequently multiplied with a weighting factor in multiplication point 57 and arrives at an addition point 58 together with a value for intake air temperature TANS. On the output side, addition point 58 is connected to the input of a downstream filter 59 which may be formed, for example, as a low pass and ultimately supplies a signal value for the temperature of the recirculated exhaust gas (TAbgas). To take into account of the volume of the recirculated exhaust gas on the temperature of the recirculated exhaust gas, the value of the AGR volume is guided via one characteristic 61 and 62 each to multiplication point 57 and to filter 59, respectively, to influence the filter constant of filter 59.

The signal representation of the individual figures makes it clear that the basic idea of the present invention is to specify a method and a device for the approximate determination of the temperature of the intake air in the vicinity of the intake valves, the thermal time constant of the intake manifold being taken into account as well as the influence of an external exhaust gas recirculation.

What is claimed is:

1. A method for controlling an internal combustion engine, comprising the steps of:

determining, using one of a calculation procedure and a measurement procedure, a value of an intake air temperature remote from the internal combustion engine;

determining a corrected value of the intake air temperature according to the following formula:

$$TANSK=T1+(TWS-T1)*f,$$

wherein TANSK is the corrected value, T1 is the value of the intake air temperature, TWS is a mean temperature value of an intake manifold, and f is a weighting factor ranging between 0 and 1; and controlling the internal combustion engine as a function of performance characteristics which include the corrected value.

2. The method according to claim 1, wherein the performance characteristics include a load, an engine speed, a temperature of the internal combustion engine and the intake air temperature.

3. The method according to claim 1, further comprising the step of:

determining the weighting factor as a function of the performance characteristics.

4. The method according to claim 3, further comprising the step of:

determining the weighting factor as a function of an air flow volume in the intake manifold.

5. The method according to claim 3, further comprising the step of:

determining the weighting factor as a function of an engine speed and a load.

6. The method according to claim 1, further comprising the step of:

determining the mean temperature value of the intake manifold as a function of a weighted mean of a temperature of the internal combustion engine and a measured value of the intake air temperature.

7. The method according to claim 6, further comprising the step of:

determining the weighted mean as a function of the performance characteristics.

8. The method according to claim 6, wherein the performance characteristics include one of a load and an intake air volume.

9. A device for controlling an internal combustion engine, comprising:

a controller determining a corrected value of an intake air temperature using the following formula:

$$TANSK=T1+(TWS-T1)*f$$

wherein TANSK is the corrected value, T1 is a value of the intake air temperature remote from the internal combustion engine which is determined using one of a calculation procedure and a measurement procedure, TWS is a value of a mean temperature of an intake manifold, and f is a weighting factor ranging between 0 and 1, wherein the controller controls internal combustion engine as a function of the corrected value.

10. A method for controlling an internal combustion engine, comprising the steps of:

determining, using one of a calculation procedure and a measurement procedure, a value of an intake air temperature remote from the internal combustion engine;

determining a corrected value of the intake air temperature according to the following formula:

$$TANSK=T1+(TWS-T1)*f,$$

wherein TANSK is the corrected value, T1 is the value of the intake air temperature, TWS is a mean temperature value of an intake manifold, and f is a weighting factor ranging between 0 and 1;

controlling the internal combustion engine as a function of performance characteristics which include the corrected value;

determining the mean temperature value of the intake manifold as a function of a weighted mean of a temperature of the internal combustion engine and the measured value of the intake air temperature; and determining the weighted mean as a function of the performance characteristics, wherein the performance characteristics include a vehicle speed.

11. A method for controlling an internal combustion engine, comprising the steps of:

determining, using one of a calculation procedure and a measurement procedure, a value of an intake air temperature remote from the internal combustion engine;

determining a corrected value of the intake air temperature according to the following formula:

$$TANSK=T1+(TWS-T1)*f,$$

wherein TANSK is the corrected value, T1 is the value of the intake air temperature, TWS is a mean temperature value of an intake manifold, and f is a weighting factor ranging between 0 and 1;

controlling the internal combustion engine as a function of performance characteristics which include the corrected value;

determining the mean temperature value of the intake manifold as a function of a weighted mean of a temperature of the internal combustion engine and the measured value of the intake air temperature;

determining a first characteristic value as a function of at least one of a vehicle speed and an air volume;

determining a second characteristic value as a function of the vehicle speed and the air volume; and determining the mean temperature value of the intake manifold according to the formula:

$$TWS=(TMOT+TANS*K1)/(1+K2),$$

wherein TMOT is the temperature of the internal combustion engine, TANS is the measured value of the intake air temperature, K1 is the first characteristic value, and K2 is the second characteristic value.

12. A method for controlling an internal combustion engine, comprising the steps of:

determining, using one of a calculation procedure and a measurement procedure, a value of an intake air temperature remote from the internal combustion engine;

determining a corrected value of the intake air temperature according to the following formula:

$$TANSK=T1+(TWS-T1)*f,$$

wherein TANSK is the corrected value, T1 is the value of the intake air temperature, TWS is a mean temperature value of an intake manifold, and f is a weighting factor ranging between 0 and 1;

controlling the internal combustion engine as a function of performance characteristics which include the corrected value; and determining the mean temperature value of the intake manifold using a filter time constant and a performance characteristic-dependent time constant.

13. A method for controlling an internal combustion engine, comprising the steps of:

determining, using one of a calculation procedure and a measurement procedure, a value of an intake air temperature remote from the internal combustion engine;

determining a corrected value of the intake air temperature according to the following formula:

$$TANSK=T1+(TWS-T1)*f,$$

wherein TANSK is the corrected value, T1 is the value of the intake air temperature, TWS is a mean temperature value of an intake manifold, and f is a weighting factor ranging between 0 and 1;

controlling the internal combustion engine as a function of performance characteristics which include the corrected value; and determining the value of the intake air temperature according to the following formula:

$$T1=TANS+AGR\ \text{rate}*(TAGR-TANS),$$

wherein AGR rate is a rate of a recirculated exhaust gas and TAGR is a temperature of the recirculated exhaust gas.

14. The method according to claim 13, further comprising the steps of:

estimating the temperature of the recirculated exhaust gas as a function of a low pass-filtered weighted mean of the exhaust gas temperature and the measured value of the intake air temperature; and determining the weighting factor and a filter time constant as a function of a gas flow rate in an exhaust gas recirculation line.

* * * * *